US008453739B2

(12) United States Patent
Parsche

(10) Patent No.: US 8,453,739 B2
(45) **Date of Patent: *Jun. 4, 2013**

(54) TRIAXIAL LINEAR INDUCTION ANTENNA ARRAY FOR INCREASED HEAVY OIL RECOVERY

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 255 days.

This patent is subject to a terminal disclaimer.

(21) Appl. No.: 12/950,405

(22) Filed: Nov. 19, 2010

(65) Prior Publication Data

US 2012/0125609 A1 May 24, 2012

(51) Int. Cl.
*E21B 43/24* (2006.01)

(52) U.S. Cl.
USPC ..... 166/302; 166/60

(58) Field of Classification Search
USPC ..... 166/302, 57, 60, 62
See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |
| 3,497,005 | A | 2/1970 | Pelopsky |
| 3,848,671 | A | 11/1974 | Kern |
| 3,954,140 | A | 5/1976 | Hendrick |
| 3,988,036 | A | 10/1976 | Fisher |
| 3,991,091 | A | 11/1976 | Driscoll |
| 4,035,282 | A | 7/1977 | Stuchberry et al. |
| 4,042,487 | A | 8/1977 | Seguchi |
| 4,087,781 | A | 5/1978 | Grossi et al. |
| 4,136,014 | A | 1/1979 | Vermeulen |
| 4,140,179 | A | 2/1979 | Kasevich et al. |
| 4,140,180 | A | 2/1979 | Bridges et al. |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

"Oil sands." Wikipedia, the free encyclopedia. Retrieved from the Internet from: http://en.wikipedia.org/w/index.php?title=Oil_sands&printable=yes, Feb. 16, 2009.

(Continued)

*Primary Examiner* — William P Neuder
(74) *Attorney, Agent, or Firm* — Allen, Dyer, Doppelt, Milbrath & Gilchrist, P.A.

(57) ABSTRACT

A radio frequency applicator and method for heating a hydrocarbon formation is disclosed. An aspect of at least one embodiment disclosed is a linear radio frequency (RF) applicator. It includes a transmission line and a current return path that is insulated from the transmission line and surrounds the transmission line to create a coaxial conductor. At least one conductive sleeve is positioned around the transmission line and the current return path. The transmission line and the current return path are electrically connected to the conductive sleeve. A radio frequency source is configured to apply a signal to the transmission line. When the linear applicator is operated, a circular magnetic field forms, which creates eddy current in the formation causing heavy hydrocarbons to flow. The applicator provides enhanced oil recovery where steam may not be used.

13 Claims, 13 Drawing Sheets

U.S. PATENT DOCUMENTS 4,144,935 A 3/1979 Bridges et al.
4,146,125 A 3/1979 Sanford et al.
4,196,329 A 4/1980 Rowland et al.
4,295,880 A 10/1981 Horner
4,300,219 A 11/1981 Joyal
4,301,865 A 11/1981 Kasevich et al.
4,328,324 A 5/1982 Kock
4,373,581 A 2/1983 Toellner
4,396,062 A 8/1983 Iskander
4,404,123 A 9/1983 Chu
4,410,216 A 10/1983 Allen
4,425,227 A 1/1984 Smith
4,449,585 A 5/1984 Bridges et al.
4,456,065 A 6/1984 Heim
4,457,365 A 7/1984 Kasevich et al.
4,470,459 A 9/1984 Copland
4,485,869 A 12/1984 Sresty
4,487,257 A 12/1984 Dauphine
4,508,168 A 4/1985 Heeren
4,514,305 A 4/1985 Filby
4,524,827 A 6/1985 Bridges
4,531,468 A 7/1985 Simon
4,583,586 A 4/1986 Fujimoto et al.
4,620,593 A 11/1986 Haagensen
4,622,496 A 11/1986 Dattili
4,645,585 A 2/1987 White
4,678,034 A 7/1987 Eastlund
4,703,433 A 10/1987 Sharrit
4,790,375 A 12/1988 Bridges
4,817,711 A 4/1989 Jeambey
4,882,984 A 11/1989 Eves, II
4,892,782 A 1/1990 Fisher et al.
5,046,559 A 9/1991 Glandt
5,055,180 A 10/1991 Klaila
5,065,819 A 11/1991 Kasevich
5,082,054 A 1/1992 Kiamanesh
5,136,249 A 8/1992 White
5,199,488 A 4/1993 Kasevich
5,233,306 A 8/1993 Misra
5,236,039 A 8/1993 Edelstein
5,251,700 A 10/1993 Nelson
5,293,936 A 3/1994 Bridges
5,304,767 A 4/1994 MacGaffigan
5,315,561 A 5/1994 Grossi
5,370,477 A 12/1994 Bunin
5,378,879 A 1/1995 Monovoukas
5,506,592 A 4/1996 MacDonald
5,582,854 A 12/1996 Nosaka
5,621,844 A 4/1997 Bridges
5,631,562 A 5/1997 Cram
5,664,911 A * 9/1997 Bridges et al. ..... 405/128.4
5,746,909 A 5/1998 Calta
5,910,287 A 6/1999 Cassin
5,923,299 A 7/1999 Brown et al.
6,045,648 A 4/2000 Palmgren et al.
6,046,464 A 4/2000 Schetzina
6,055,213 A 4/2000 Rubbo
6,063,338 A 5/2000 Pham
6,097,262 A 8/2000 Combellack
6,106,895 A 8/2000 Usuki
6,112,273 A 8/2000 Kau
6,184,427 B1 2/2001 Klepfer
6,229,603 B1 5/2001 Coassin
6,232,114 B1 5/2001 Coassin
6,301,088 B1 10/2001 Nakada
6,303,021 B2 10/2001 Winter
6,348,679 B1 2/2002 Ryan et al.
6,360,819 B1 3/2002 Vinegar
6,432,365 B1 8/2002 Levin
6,603,309 B2 8/2003 Forgang
6,613,678 B1 9/2003 Sakaguchi
6,614,059 B1 9/2003 Tsujimura
6,649,888 B2 11/2003 Ryan et al.
6,712,136 B2 3/2004 de Rouffignac
6,808,935 B2 10/2004 Levin
6,923,273 B2 8/2005 Terry
6,932,155 B2 8/2005 Vinegar
6,967,589 B1 11/2005 Peters
6,992,630 B2 1/2006 Parsche
7,046,584 B2 5/2006 Sorrells
7,079,081 B2 7/2006 Parsche et al.
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,337,980 B2 3/2008 Schaedel
7,438,807 B2 10/2008 Garner et al.
7,441,597 B2 10/2008 Kasevich
7,461,693 B2 12/2008 Considine et al.
7,484,561 B2 2/2009 Bridges
7,562,708 B2 7/2009 Cogliandro
7,623,804 B2 11/2009 Sone
2002/0032534 A1 3/2002 Regier
2004/0031731 A1 2/2004 Honeycutt
2005/0199386 A1 9/2005 Kinzer
2005/0274513 A1 12/2005 Schultz
2006/0038083 A1 2/2006 Criswell
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0187089 A1 8/2007 Bridges
2007/0261844 A1 11/2007 Cogliandro et al.
2008/0073079 A1 3/2008 Tranquilla
2008/0078551 A1 4/2008 DeVault et al.
2008/0143330 A1 6/2008 Madio
2009/0009410 A1 1/2009 Dolgin et al.
2009/0050318 A1 2/2009 Kasevich
2009/0242196 A1 10/2009 Pao
2012/0125608 A1 * 5/2012 Parsche ..... 166/272.1

FOREIGN PATENT DOCUMENTS

DE 1930601 12/1969
DE 10 2008 022176 A1 11/2009
EP 0015150 9/1980
EP 0 135 966 4/1985
EP 0418117 A1 3/1991
EP 0563999 A2 10/1993
EP 1106672 A1 6/2001
FR 1586066 A 2/1970
FR 2925519 A1 6/2009
JP 56050119 A 5/1981
JP 2246502 A 10/1990
JP 11325376 11/1999
WO WO 2007/133461 11/2007
WO WO2008/011412 A2 1/2008
WO WO 2008/030337 3/2008
WO WO2008098850 A1 8/2008
WO WO2009027262 A1 8/2008
WO WO2009/114934 A1 9/2009

OTHER PUBLICATIONS

Sahni et al., "Electromagnetic Heating Methods for Heavy Oil Reservoirs." 2000 Society of Petroleum Engineers SPE/AAPG Western Regional Meeting, Jun. 19-23, 2000.

Power et al., "Froth Treatment: Past, Present & Future." Oil Sands Symposium, University of Alberta, May 3-5, 2004.

Flint, "Bitumen Recovery Technology a Review of Long Term R&D Opportunities." Jan. 31, 2005. LENEF Consulting (1994) Limited.

"Froth Flotation." Wikipedia, the free encyclopedia. Retrieved from the internet from: http://en.wikipedia.org/wiki/Froth_flotation, Apr. 7, 2009.

"Relative static permittivity." Wikipedia, the free encyclopedia. Retrieved from the Internet from http://en.wikipedia.org/w/index/php?title=Relative_static_permittivity&printable=yes, Feb. 12, 2009.

"Tailings." Wikipedia, the free encyclopedia. Retrieved from the Internet from http://en.wikipedia.org/w/index.php?title=Tailings &printable=yes, Feb. 12, 2009.

"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U. S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process for In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.
U.S. Appl. No. 12/886,338, filed Sep. 20, 2010 (unpublished).
Butler, R.M. "Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.H. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
PCT Notification of Transmittal of the International Search Report and the Written Opinion of the International Searching Authority, or the Declaration, in PCT/US2010/025761, dated Feb. 9, 2011.
PCT Notification of Transmittal of the International Search Report and the Written Opinion of the International Searching Authority, or the Declaration, in PCT/US2010/057090, dated Mar. 3, 2011.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.
Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
Kinzer, A Review of Notable Intellectual Property for In Situ Electromagnetic Heating of Oil Shale, Quaser Energy LLC, pp. 1 of 1, 2007.

* cited by examiner

TRIAXIAL LINEAR INDUCTION ANTENNA ARRAY FOR INCREASED HEAVY OIL RECOVERY

CROSS REFERENCE TO RELATED APPLICATIONS

This specification is related to the patent application identified by Harris Corporation Ser. No. 12/950,339, which is incorporated by reference here.

BACKGROUND OF THE INVENTION

The present invention relates to heating a geological formation for the extraction of hydrocarbons, which is a method of well stimulation. In particular, the present invention relates to an advantageous radio frequency (RF) applicator and method that can be used to heat a geological formation to extract heavy hydrocarbons.

As the world's standard crude oil reserves are depleted, and the continued demand for oil causes oil prices to rise, oil producers are attempting to process hydrocarbons from bituminous ore, oil sands, tar sands, oil shale, and heavy oil deposits. These materials are often found in naturally occurring mixtures of sand or clay. Because of the extremely high viscosity of bituminous ore, oil sands, oil shale, tar sands, and heavy oil, the drilling and refinement methods used in extracting standard crude oil are typically not available. Therefore, recovery of oil from these deposits requires heating to separate hydrocarbons from other geologic materials and to maintain hydrocarbons at temperatures at which they will flow.

Current technology heats the hydrocarbon formations through the use of steam and sometimes through the use of RF energy to heat or preheat the formation. Steam has been used to provide heat in-situ, such as through a steam assisted gravity drainage (SAGD) system. Steam enhanced oil recovery may not be suitable for permafrost regions due to surface melting, in stratified and thin pay reservoirs with rock layers, and where there is insufficient cap rock. Well start up, for example, the initiation of the steam convection, may be slow and unreliable as conducted heating in hydrocarbon ores is slow. Radio frequency electromagnetic heating is known for speed and penetration so unlike steam, conducted heating to initiate convection may not be required.

A list of possibly relevant patents and literature follows:

| | |
|---|---|
| US2007/0187089 | Bridges |
| US2008/0073079 | Tranquilla et al. |
| 12/886,338 filed on Sep. 20, 2010 | Parsche |
| 2,685,930 | Albaugh |
| 3,954,140 | Hendrick |
| 4,140,180 | Bridges et al. |
| 4,144,935 | Bridges et al. |
| 4,328,324 | Kock et al. |
| 4,373,581 | Toellner |
| 4,410,216 | Allen |
| 4,457,365 | Kasevich et al. |
| 4,485,869 | Sresty et al. |
| 4,508,168 | Heeren |
| 4,524,827 | Bridges et al. |
| 4,620,593 | Haagensen |
| 4,622,496 | Dattilo et al. |
| 4,678,034 | Eastlund et al. |
| 4,790,375 | Bridges et al. |
| 5,046,559 | Glandt |
| 5,082,054 | Kiamanesh |
| 5,236,039 | Edelstein et al. |
| 5,251,700 | Nelson et al. |

-continued

| | |
|---|---|
| 5,293,936 | Bridges |
| 5,370,477 | Bunin et al. |
| 5,621,844 | Bridges |
| 5,910,287 | Cassin et al. |
| 6,046,464 | Schetzina |
| 6,055,213 | Rubbo et al. |
| 6,063,338 | Pham et al. |
| 6,112,273 | Kau et al. |
| 6,229,603 | Coassin, et al. |
| 6,232,114 | Coassin, et al. |
| 6,301,088 | Nakada |
| 6,360,819 | Vinegar |
| 6,432,365 | Levin et al. |
| 6,603,309 | Forgang, et al. |
| 6,613,678 | Sakaguchi et al. |
| 6,614,059 | Tsujimura et al. |
| 6,712,136 | de Rouffignac et al. |
| 6,808,935 | Levin et al. |
| 6,923,273 | Terry et al. |
| 6,932,155 | Vinegar et al. |
| 6,967,589 | Peters |
| 7,046,584 | Sorrells et al. |
| 7,109,457 | Kinzer |
| 7,147,057 | Steele et al. |
| 7,172,038 | Terry et al |
| 7,322,416 | Burris, II et al. |
| 7,337,980 | Schaedel et al. |
| 7,562,708 | Cogliandro et al. |
| 7,623,804 | Sone et al. |
| Development of the IIT Research Institute RF Heating Process for In Situ Oil Shale/Tar Sand Fuel Extraction - An Overview | Carlson et al. |

SUMMARY OF THE INVENTION

An aspect of at least one embodiment of the present invention is a triaxial linear RF applicator. The applicator is generally used to heat a hydrocarbon formation. It includes a transmission line and a current return path that is insulated from and surrounds the transmission line. At least one conductive sleeve having first and second ends is positioned around the current return path. The conductive sleeve is electrically connected to the transmission line at the first end of the conductive sleeve, and it is electrically connected to the current return path at the second end of the conductive sleeve. A radio frequency source is configured to apply a signal to the transmission line and is connected to the transmission line and the current return path.

Yet another aspect of at least one embodiment of the present invention involves a method for heating a hydrocarbon formation. A linear applicator is extended into a hydrocarbon formation and is positioned within an ore region within the hydrocarbon formation. A radio frequency signal is applied to the linear applicator, which creates a circular magnetic field relative to the radial axis of the linear applicator. The magnetic field creates eddy currents within the hydrocarbon formation, which heat the formation and cause heavy hydrocarbons to flow.

Other aspects of the invention will be apparent from this disclosure.

DETAILED DESCRIPTION OF THE PREFERRED EMBODIMENTS

Figure 1:
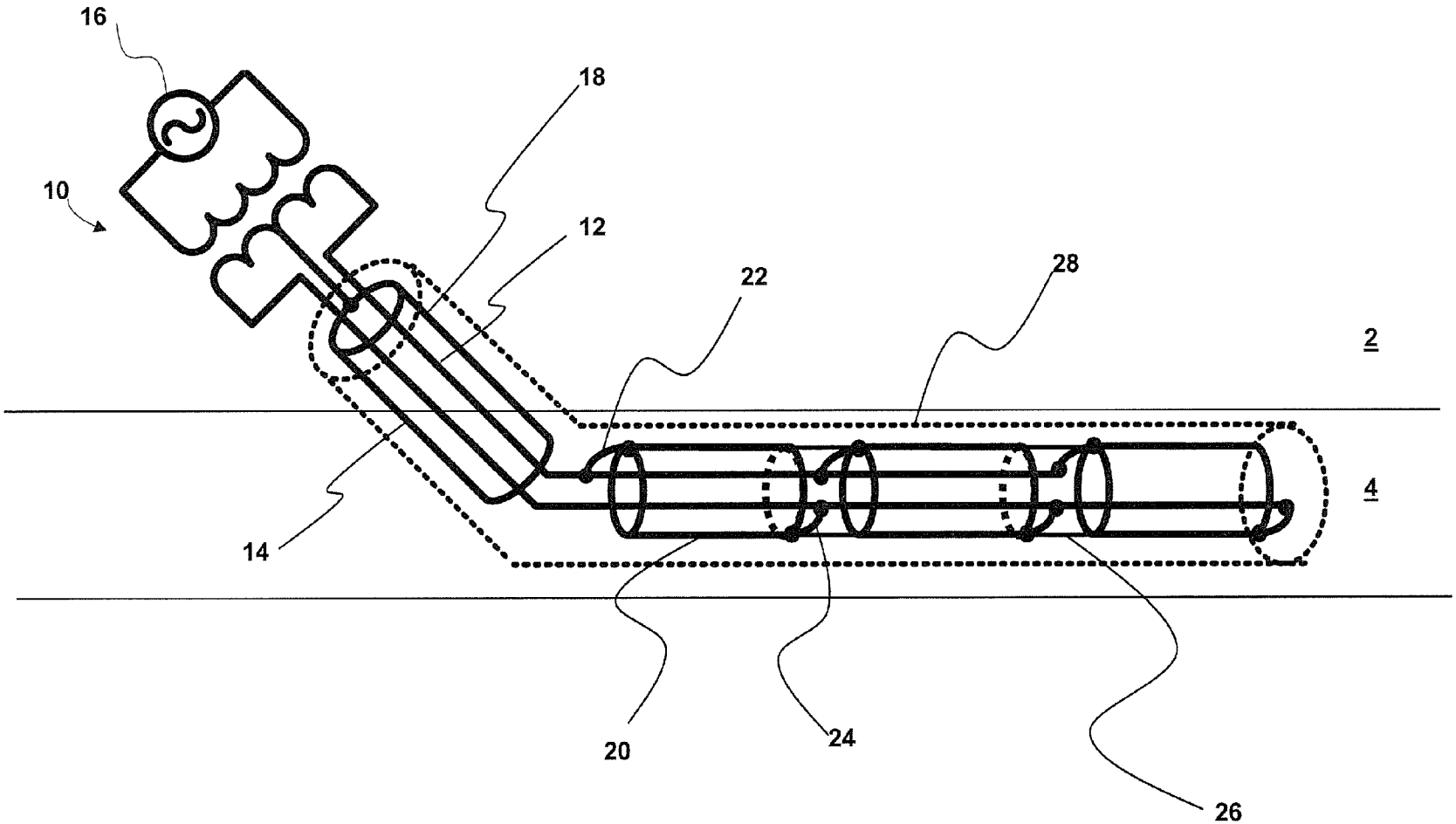
FIG. 1 is a diagrammatic perspective view of an embodiment of a twinaxial linear applicator.

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

Radio frequency (RF) heating is heating using one or more of three energy forms: electric currents, electric fields, and magnetic fields at radio frequencies. Depending on operating parameters, the heating mechanism may be resistive by joule effect or dielectric by molecular moment. Resistive heating by joule effect is often described as electric heating, where electric current flows through a resistive material. Dielectric heating occurs where polar molecules, such as water, change orientation when immersed in an electric field. Magnetic fields also heat electrically conductive materials through eddy currents, which heat inductively.

RF heating can use electrically conductive antennas to function as heating applicators. The antenna is a passive device that converts applied electrical current into electric fields, magnetic fields, and electrical current fields in the target material, without having to heat the structure to a specific threshold level. Preferred antenna shapes can be Euclidian geometries, such as lines and circles. Additional background information on dipole antenna can be found at S. K. Schelkunoff & H. T. Friis, *Antennas: Theory and Practice*, pp 229-244, 351-353 (Wiley New York 1952). The radiation patterns of antennas can be calculated by taking the Fourier transforms of the antennas' electric current flows. Modern techniques for antenna field characterization may employ digital computers and provide for precise RF heat mapping.

Susceptors are materials that heat in the presence of RF energies. Salt water is a particularly good susceptor for RF heating; it can respond to all three types of RF energy. Oil sands and heavy oil formations commonly contain connate liquid water and salt in sufficient quantities to serve as a RF heating susceptor. For instance, in the Athabasca region of Canada and at 1 KHz frequency, rich oil sand (15% bitumen) may have about 0.5-2% water by weight, an electrical conductivity of about 0.01 s/m (Siemens/meter), and a relative dielectric permittivity of about 120. As bitumen melts below the boiling point of water, liquid water may be a used as an RF heating susceptor during bitumen extraction, permitting well stimulation by the application of RF energy. In general, RF heating has superior penetration to conductive heating in hydrocarbon formations. RF heating may also have properties of thermal regulation because steam is a not an RF heating susceptor.

Heating subsurface heavy oil bearing formations by prior RF systems has been inefficient, in part, because prior systems use resistive heating techniques, which require the RF applicator to be in contact with water in order to heat the formation. Liquid water contact can be unreliable because live oil may deposit nonconductive asphaltines on the electrode surfaces and because the water can boil off the surfaces. Heating an ore region through primarily inductive heating, electric and magnetic, can be advantageous.

FIG. 1 shows a diagrammatic representation of an RF applicator that can be used, for example, to heat a hydrocarbon formation. The applicator generally indicated at 10 extends through an overburden region 2 and into an ore region 4. Throughout the ore region 4 the applicator is generally linear and can extend horizontally over one kilometer in length. Electromagnetic radiation provides heat to the hydrocarbon formation, which allows heavy hydrocarbons to flow. The hydrocarbons can then be captured by one or more extraction pipes (not shown) located within or adjacent to the ore region 4.

The applicator 10 includes a transmission line 12, a current return path 14, a radio frequency source 16, a conductive shield 18, conductive sleeves 20, first conductive jumpers 22, second conductive jumpers 24, insulator couplings 26, and a nonconductive housing 28.

Both the transmission line 12 and the current return path 14 can be, for example, a pipe, a copper line, or any other conductive material, typically metal. The transmission line 12 is separated from the current return path 14 by insulative materials (not shown). Examples include glass beads, trolleys with insulated or plastic wheels, polymer foams, and other nonconductive or dielectric materials. When the applicator 12, is in operation, the current return path 14 is oppositely electrically oriented with respect to the transmission line 12. In order words, electrical current I flows in the opposite direction on the current return path 14 than it does on the transmission line 12. In FIG. 1, the transmission line 10 is substantially parallel to the current return path 12 and this type of configuration may be referred to as a twinaxial linear applicator.

The RF source 16 is connected to the transmission line 12 and the current return path 14 and is configured to apply a signal with a frequency f to the transmission line 12. In practice, frequencies between 1 kHz and 10 kHz can be effective to heat a hydrocarbon formation, although the most efficient frequency at which to heat a particular formation can be affected by the composition of the ore region 4. It is contemplated that the frequency can be adjusted according to well known electromagnetic principles in order to heat a particular hydrocarbon formation more efficiently. Simulation software indicates that the RF source can be operated effectively at 1 Watt to 5 Megawatts power.

An example of a suitable method for Athabasca formations may be to apply about 1 to 3 kilowatts of RF power per meter of well length initially and to do so for 1 to 4 months to start up. Sustaining, production power levels may be reduced to about ten to twenty percent of the start up amount or steam may be used after RF startup. The RF source 16 can include a transmitter and an impedance matching coupler including devices such transformers, resonating capacitors, inductors, and other known components to conjugate match and manage the dynamic impedance changes of the ore load as it heats. The transmitter may also be an electromechanical device such as a multiple pole alternator or a variable reluctance alternator with a slotted rotor that modulates coupling between two inductors. The RF source 16 may also be a vacuum tube device, such as an Eimac 8974/X-2159 power tetrode or an array of solid state devices. Thus, there are many options to realize RF source 16.

The conductive shield 18 surrounds the transmission line 12 and the current return path 14 throughout the overburden region 2. The conductive shield 18 can be comprised of any conductive material and can be, for example, braided insulated copper wire strands, which may be arranged similar to a typical litz construction, or the conductive shield 18 can be a solid or substantially solid metal sleeve, such as corrugated copper pipe or steel pipe. The conductive shield 18 is separated from the transmission line 12 and the current return path 14 by insulative materials (not shown). Examples include glass beads, trolleys with insulated or plastic wheels, polymer foams, and other nonconductive or dielectric materials. The conductive shield 18 is not electrically connected to the transmission line 12 or the current return path 14 and thus serves to keep this section of the applicator 10 electrically neutral. Thus, when the applicator 10 is operated, electromagnetic radiation is concentrated within the ore region 4. This is an advantage because it is desirable not to divert energy by heating the overburden region 2, which is typically highly conductive.

At very low frequency or for direct current, the need for current choking in the overburden region 2 can be satisfied by providing insulation around the transmission line 12 and the current return path 14 without the use of the conductive shield 18. Thus, at very low frequency (lower than about 60 Hz) or for direct current, the conductive shield 18 is optional.

One or more conductive sleeves 20 surround the transmission line 12 and the current return path 14 throughout the ore region 4. The conductive sleeves 20 can be comprised of any conductive material and can be, for example, braided insulated copper wire strands, which may be arranged similar to a typical litz construction or the conductive sleeves 20 can be a solid or substantially solid metal sleeve, such as corrugated copper pipe or steel pipe. The conductive sleeves 20 are separated from the transmission line 12 and the current return path 14 by insulative materials (not shown). Examples include glass beads, trolleys with insulated or plastic wheels, polymer foams, and other nonconductive or dielectric materials.

Each conductive sleeve 20 is connected to the transmission line 12 through a first conductive jumper 22 and is connected to the current return path 14 through a second conductive jumper 24. Both the first conductive jumpers 22 and the second conductive jumpers 24 can be, for example, a copper pipe, a copper strap, or other conductive metal. The first conductive jumper 22 feeds current from the transmission line 12 onto the conductive sleeve 20. Similarly, the second conductive jumper 24 removes current from the conductive sleeve 20 and onto the current return path 14. Together the transmission line 12, the first conductive jumper 22, the conductive sleeve 20, the second conductive jumper 24, and the current return path 14 create a closed electrical circuit, which is an advantage because the combination of these features allows the applicator 10 to generate magnetic near fields so the antenna need not have conductive electrical contact with the ore. The closed electrical circuit provides a loop antenna circuit in the linear shape of a dipole. The linear dipole antenna is practical to install in the long, linear geometry of oil well holes whereas circular loop antennas may be impractical or nearly so. The conductive sleeve 24 functions as an antenna applicator on its outside surface and as a transmission line shield on its inner surface. This prevents cancellations between the magnetic fields of the forward and reverse current paths of the circuit.

Figure 2:
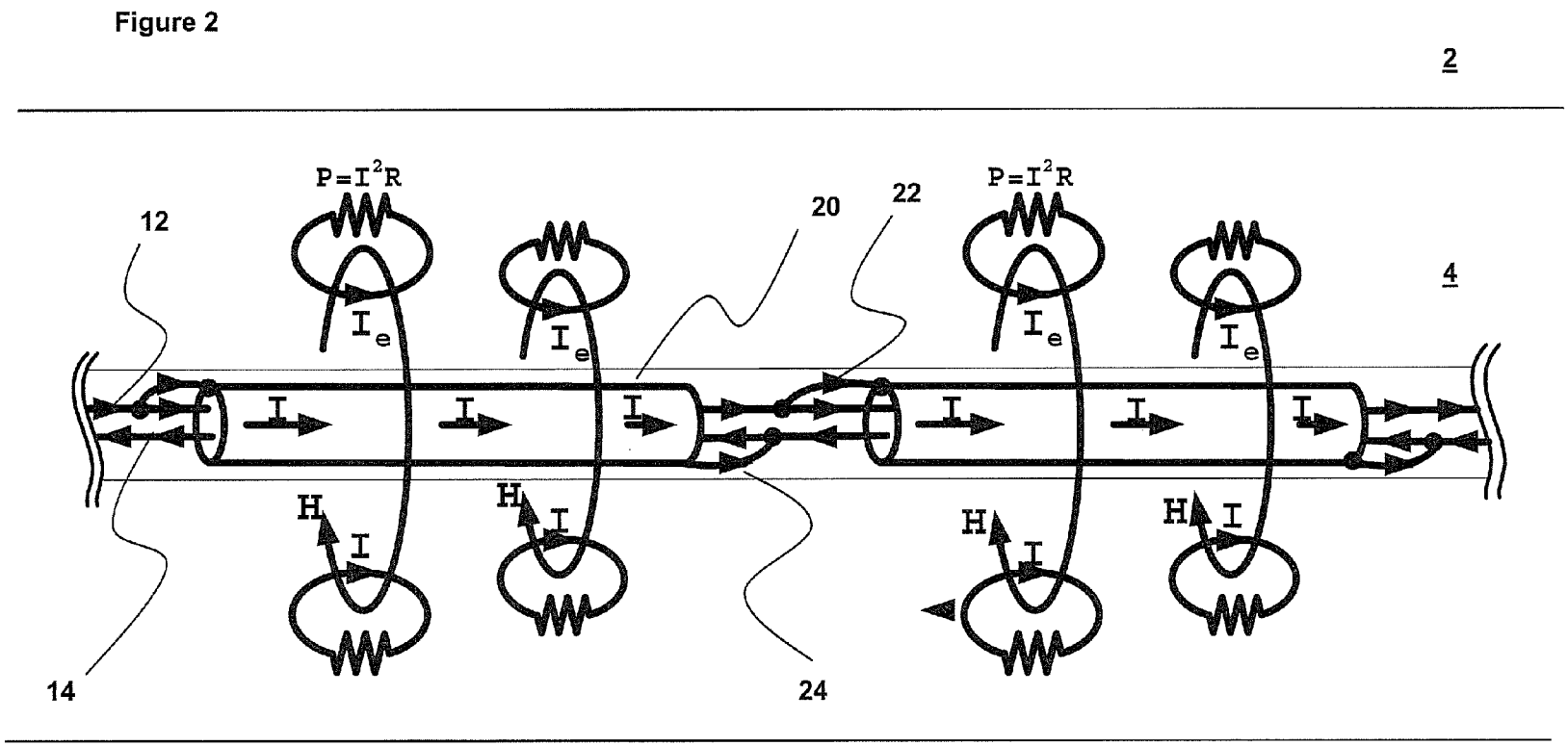
FIG. 2 is a diagrammatic perspective view of an embodiment of a twinaxial linear applicator.

FIG. 2 depicts two conductive sleeves 20 and shows resulting fields and currents that are created when the applicator 10 is operated. When the applicator 10 is operated, current I flows through the conductive sleeve 20, which creates a circular magnetic induction field H, which expands outward radially with respect to each conductive sleeve 20. Each magnetic field H in turn creates eddy currents $I_e$, which heat the ore region 4 and cause heavy hydrocarbons to flow. The operative mechanisms are Ampere's Circuital Law:

$$\int B \sim dl$$

and Lentz's Law:

$$\delta W = H \cdot B$$

to form the magnetic near field and the eddy current respectively. The magnetic field can reach out as required from the antenna applicator 10, through electrically nonconductive steam saturation areas, to reach the hydrocarbon face at the heating front.

Returning to FIG. 1, it depicts three conductive sleeves 20 along the length of the applicator 10 in the ore region 4. Simulations have shown that as the current I flows along each conductive sleeve 20, it dissipates along the length of the conductive sleeve 20, thereby creating a less effective magnetic field H at the far end of each conductive sleeve 20 with respect to the radio frequency source 16. Thus, the length of each conductive sleeve 20 can be about 40 meters or less for effective operation when the applicator 10 is operated at about 1 to 10 kilohertz. However, the length of each conductive sleeve 20 can be greater or smaller depending on a particular applicator 10 used to heat a particular ore region 4. A preferred length for the conductive sleeve 20 is about:

$$\delta = \sqrt{(2/\sigma\omega\mu)}$$

Where:

- $\delta$=the RF skin depth=the preferred length for the conductive sleeve 20
- $\sigma$=the electrical conductivity of the underground ore in mhos/meter
- $\omega$=the angular frequency of the RF current source 16 in radians=$2\pi$ (frequency in hertz)
- $\mu$=the absolute magnetic permeability of the conductor=$\mu_0\mu_r$ The applicator 10 can extend one kilometer or more horizontally through the ore region 4. Thus, in practice an applicator may consist of an array of twenty (20) or more conductive sleeves 20, depending on the electrical conductivity of the underground formation. The conductivity of Athabasca oil sand bitumen ores can be between 0.002 and 0.2 mhos per meter depending on hydrocarbon content. The richer ores are less electrically conductive. In general, the conductive sleeves 20 are electrically small, for example, they are much shorter than both the free space wavelength and the wavelength in the media they are heating. The array formed by the sleeves is excited by approximately equal amplitude and equal phase currents. The realized current distribution along the array of conductive sleeves 10 forming the applicator 10 may initially approximate a shallow serrasoid (sawtooth); a binomial distribution after steam saturation temperatures is reached in the formation. Varying the frequency of the RF source 16 is a contemplated method to approximate a uniform distribution for even heating.

FIG. 1 also depicts optional parts of the applicator including nonconductive couplings 26 and nonconductive housing 28. Nonconductive couplings 26 can be comprised of any nonconductive material, such as, for example, plastic or fiberglass pipe. Each nonconductive coupling 26 electrically insulates a conductive sleeve 20 from an adjacent conductive sleeve 20. The nonconductive couplings 26 can be connected to the conductive sleeves 20 through any fastening mechanism able to withstand the conditions present in a hydrocarbon formation including, for example, screws or nuts and bolts. Alternating conductive sleeves 20 and nonconductive couplings 26 can be assembled prior to installing applicator 10 to form one continuous pipe with alternating sections of conductive and nonconductive material.

Nonconductive housing 28 surrounds the applicator 10. The nonconductive housing may be comprised of any electrically nonconductive material including, for example, fiberglass, polyimide, or asphalt cement. The nonconductive housing 28 prevents conductive electrical connection between the antenna applicator 10 and the ore. This has number of advantages. The electrical load resistance obtained from the hydrocarbon ore is raised as electrode-like behavior, for example, injection of electrons or ions, is prevented and the wiring gauges can be smaller. Electrical load impedance of ore is stabilized during the heating, which prevents a drastic jump in resistance when the liquid water ceases to contact the applicator 10. Corrosion of metals is reduced or eliminated. The conductive sleeves 20 can be longer as the energy coupling rate into the ore, per length, is reduced. Induction heating with magnetic fields has a beneficial transformer like effect to obtain high electrical load resistances that is preferable to electrode direct conduction.

The applicator 10 is akin to a transformer primary winding, the underground ore akin to a transformer secondary winding and the virtual transformer obtained is of the step up variety. Equivalent windings ratios of 4 to 20 are obtained. Passing a linear conductor through conductive material has coupling effects akin to a 1 turn transformer winding around the material. The inclusion or noninclusion of nonconductive housing 20 is thus a contemplated method to select for induction heating by applying magnetic fields or contact heating applying electric currents. The nonconductive housing 28 may allow the antenna applicator 10 to be withdrawn from the formation and reused at another formation.

Figure 3:
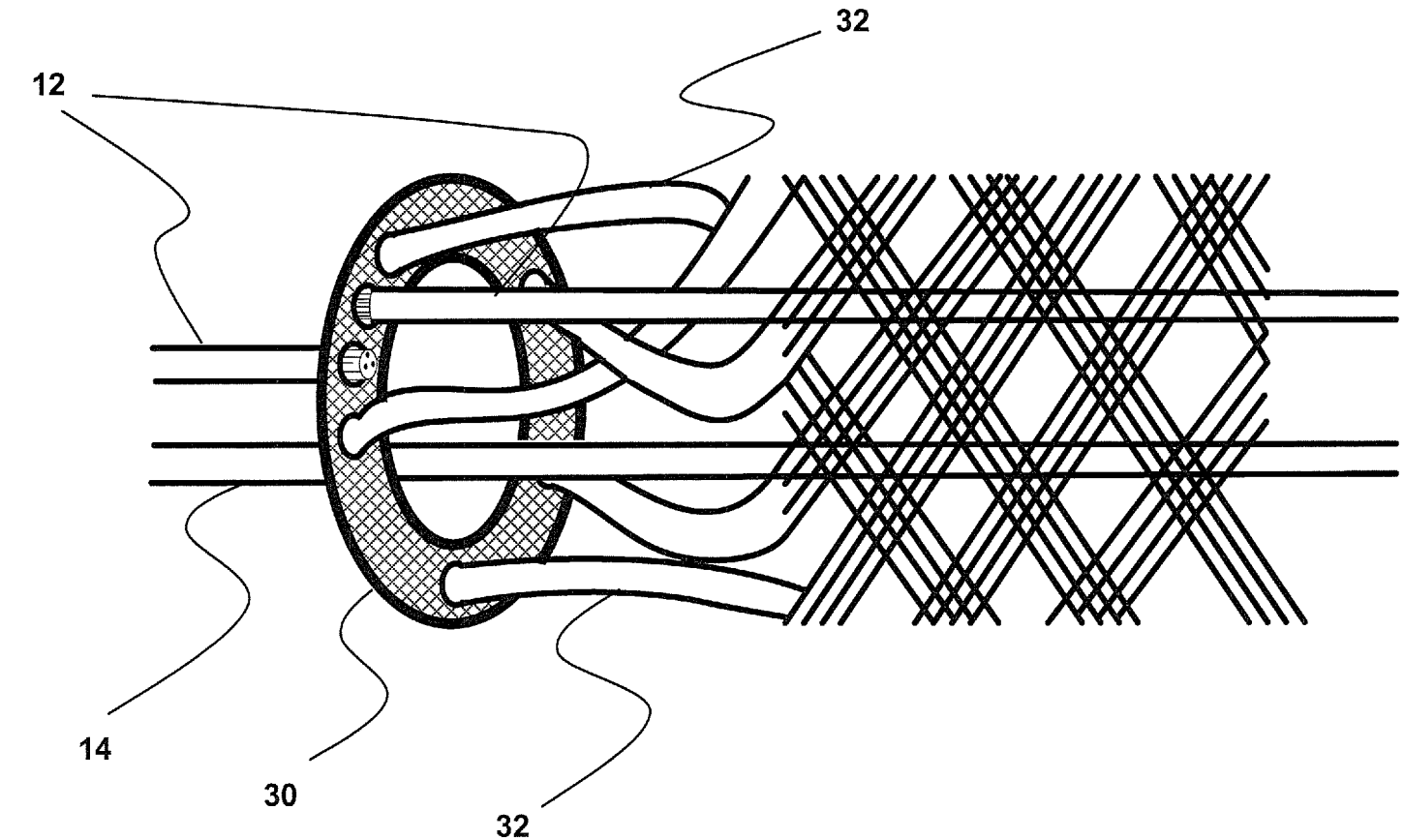
FIG. 3 is a diagrammatic perspective view of an embodiment of a litz bundle type conductive sleeve.

FIG. 3 shows an alternative embodiment, which doesn't require first conductive jumper 22 or second conductive jumper 24 to connect a litz wire type conductive sleeve 20 to the transmission line 12. Rather, the function of the conductive jumper is implemented through header flange 30 to which the transmission line 12 and each litz bundle 32 is connected. Notice that the current return path 14 is not connected to the header flange 30 at this end of conductive sleeve 20. Rather, another header flange 30 (not shown) is present at the other end of the conductive sleeve 20, to which the current return path 14 and the each litz bundle 32 is connected to the conductive sleeve 20 but not the transmission line 12. Each of the transmission line 12, the current return path 14, and the litz bundles 32 can be soldered to the header flange 30.

Figure 4:
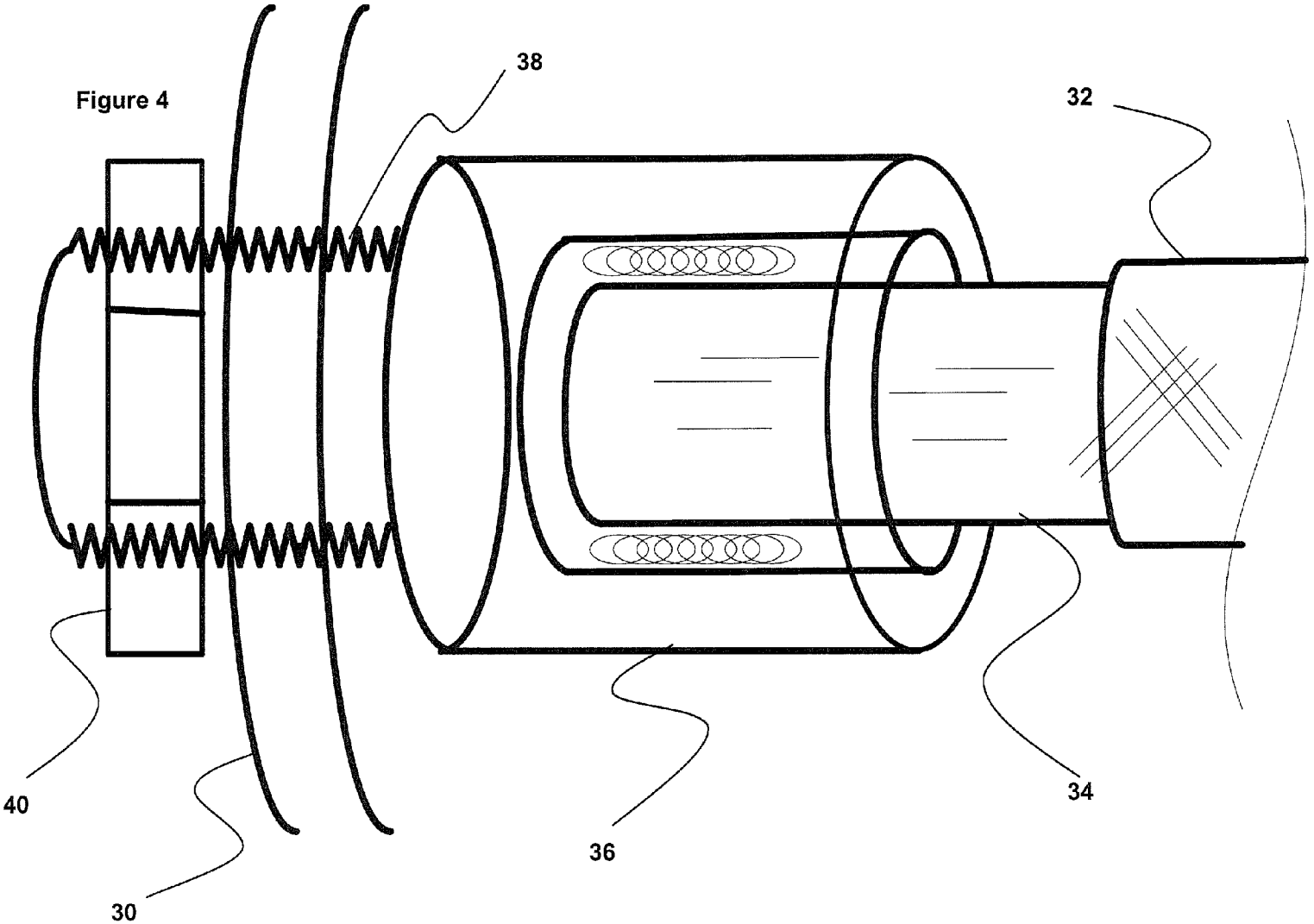
FIG. 4 is a diagrammatic perspective view of an embodiment of a connection mechanism to connect a litz bundle to a header flange.

FIG. 4 depicts another method of connecting a litz bundle 32 to the header flange 30. In this embodiment, an exposed end 34 of a litz bundle 32 is soldered into a solder cup bolt stud 36. The threaded end 38 of the solder cup bolt stud 36 is then affixed to the header flange 30 with a nut 40.

When the applicator 10 contains litz bundle type conductive sleeves 20 or other flexible conductive sleeves 20, the applicator 10 can be flexible as a whole if it also contains flexible insulative material, a flexible transmission line 12, and a flexible current return path 14. Such an embodiment can generally fit into a hole of any shape and orientation, that may be for example, not be entirely in the same horizontal or vertical plane. Thus making such an applicator 10 particularly appropriate for use in a hydrocarbon formation with an irregularly shaped ore region.

Figure 5:
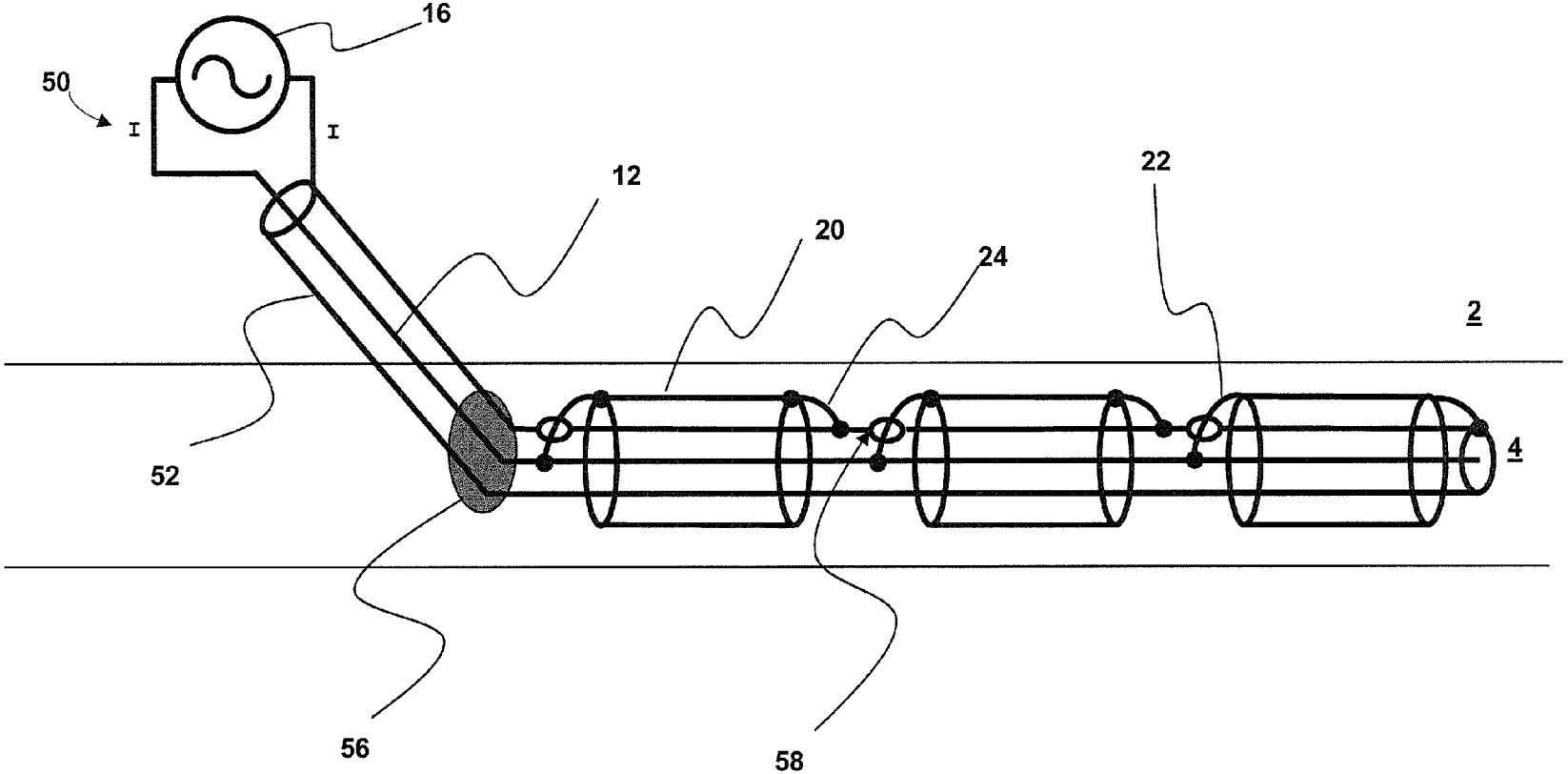
FIG. 5 is a diagrammatic perspective view of an embodiment of a triaxial linear applicator FIG. 6 a diagrammatic perspective view of an embodiment of a twinaxial linear applicator.

FIG. 5 shows a diagrammatic representation of yet another contemplated embodiment. The applicator 50 includes a transmission line 12, a current return path 52, a radio frequency source 54, a current choke 56, conductive sleeves 20, first conductive jumpers 22, and second conductive jumpers 24.

The transmission line 12 is the same transmission line described above with respect to FIG. 1. It can be, for example, a pipe, a copper line, or any other conductive material, typically metal. The transmission line 12 is separated from the current return path 52 by insulative materials (not shown). Examples include glass beads, trolleys with insulated or plastic wheels, polymer foams, and other nonconductive or dielectric materials. In this embodiment, the current return path 52 surrounds the transmission line 12, thereby creating a coaxial conductor throughout the overburden region 2. The current return path 52 can be a pipe and may be comprised of any conductive metal, such as, for example, copper or steel. Additionally the current return path 52 can be a preexisting well pipe that is substantially horizontal within the ore region 2, such as one that is part of an existing Steam Assisted Gravity Drainage (SAGD) system.

The radio frequency source 54 can be the same or similar to the radio frequency source described above with respect to FIG. 1. The radio frequency source 54 will include dynamic impedance matching provisions, for example, the source impedance will be varied as the load resistance changes. Reactors such as inductors and capacitors may be included to correct power factor. In general, the electrical resistance seen by the radio frequency source 54 rises as the underground heating progresses. If nonconductive housing 28 is included around the applicator 10 the resistance may rise by a factor of about 3 to 5 during the heating process. The reactance generally changes less than the resistance.

A current choke 56 surrounds the current return path 52 and is configured to choke current flowing along the outside of the current return path 52. The current choke 56 can be any common mode choke or antenna balun sufficient to prevent current from flowing on the outside surface of the current return path 52. The current choke 56 can be, for example, comprised of a magnetic material and vehicle. For example, the magnetic material can be nickel zinc ferrite powder, pentacarbonyl E iron powder, powdered magnetite, iron filings, or any other magnetic material. The vehicle can be, for example, silicone rubber, vinyl chloride, epoxy resin, or any other binding substance. The vehicle may also be a cement, such as Portland cement. Alternatively, the current choke 56 can be comprised of alternative magnetic material rings and insulator rings, for example, laminations. The magnetic material rings can be, for example, silicon steel. The insulator rings, can be any insulator, such as glass, rubber, or a paint or oxide coating on the magnetic material rings. Such current chokes are more fully disclosed in pending application Ser. No. 12/886,338 filed on Sep. 20, 2010.

The current choke 56 allows the electromagnetic fields to be concentrated within the ore region 4. This is an advantage because it is desirable not to divert energy by heating the overburden region 2, which is typically highly conductive. The current choke 56 forms a series inductor in place along current return path 52, having sufficient inductive reactance to suppress RF currents from flowing on the exterior of the current return path 52, beyond the physical location of the current choke 56. That is, the current choke 56 keeps the RF current from flowing up the outside surface of the current return path 52 into the overburden region 2. The current choke 56 functions as an inductor to provide series inductive reactance. The inductive reactance in ohms of the current choke 56 may typically be adjusted to 10 times or more the electrical load resistance of the ore formation.

In the illustrated embodiment, conductive sleeves 20 surround the current return path 52. These conductive sleeves 20 can be the same conductive sleeves 20 described above with respect to FIG. 1 and can be constructed, for example, in a litz bundle type construction, or the conductive sleeves 20 can be a solid or substantially solid metal sleeve, such as corrugated copper pipe or steel pipe. The conductive sleeves 20 are separated from the current return path 52 by insulative materials (not shown). Examples include glass beads, trolleys with insulated or plastic wheels, polymer foams, and other nonconductive or dielectric materials. Approximately equal spacing between the electrical conductors can be preferential to avoid conductor proximity effect. In FIG. 5, the conductive sleeve 20 surrounds the current return path 52, which surrounds the transmission line 10, and this type of configuration may be referred to as a triaxial linear applicator. The triaxial linear applicator provides electrical shielding and field containment for the return path currents to realize an electrically folded or loop type circuit. Thus induction heating is possible from a line shaped antenna.

Each conductive sleeve 20 is connected to the transmission line 12 through a first conductive jumper 22 and is connected to the current return path 52 through a second conductive jumper 24. These conductive jumpers can be the same as those described with respect to FIG. 1, and can be, for example, a copper pipe, a copper strap, or other conductive metal. The second conductive jumper 24 can also be a solder joint between the conductive sleeve 20 and the current return path 52, which can otherwise be known as an electrical fold. The first conductive jumper 22 feeds current from the transmission line 12 onto the conductive sleeve 20. It is connected from the transmission line 12 to the conductive sleeve 20 through an aperture 58 located in the current return path 52. Similarly, the second conductive jumper 24 removes current from the conductive sleeve 20 and onto the current return path 52. Together the transmission line 12, the first conductive jumper 22, the conductive sleeve 20, the second conductive jumper 24, and the current return path 52 create a closed electrical circuit, which is an advantage because there is electrical shielding, for example, field containment for the return path currents to realize an electrically folded or loop type circuit. Thus induction heating is possible from a line shaped antenna. The magnetic fields from the outgoing and ingoing electric currents do not cancel each other.

Figure 6:
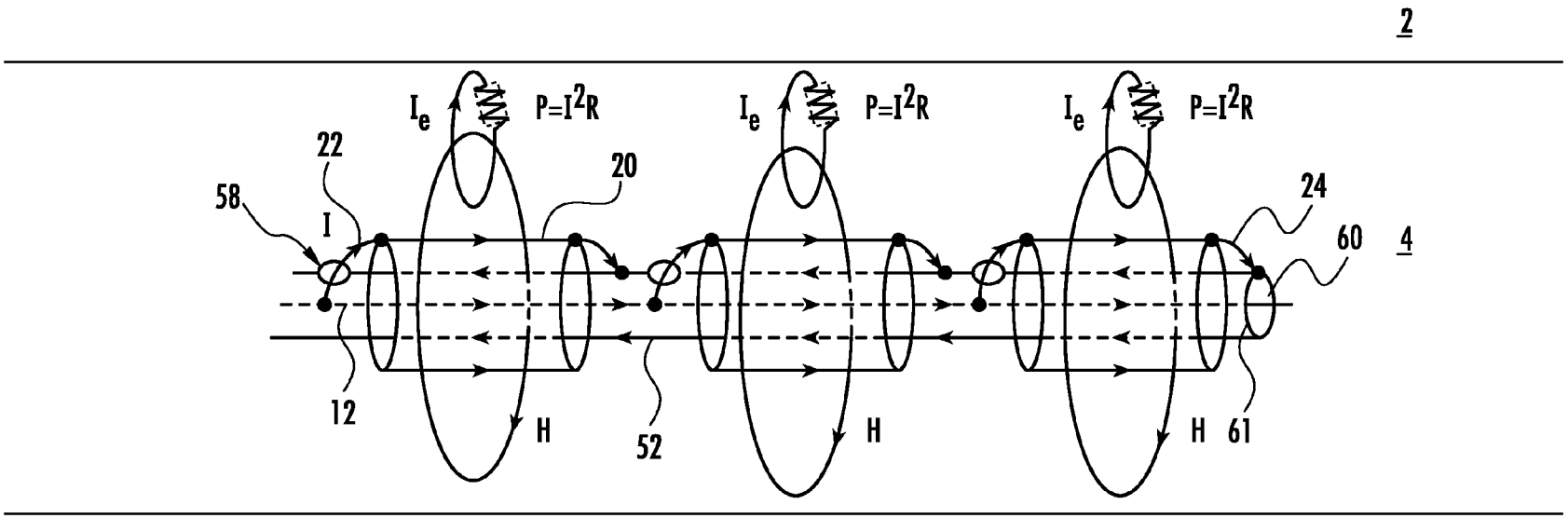

FIG. 6 depicts applicator 50 and shows resulting current flows and electromagnetic fields and that are created when the applicator 50 is operated. When applicator 50 is operated, current I is fed from the transmission line 12 onto the conductive sleeve 20, which creates a circular magnetic induction field H that expands radially with respect to each conductive sleeve 20. Each magnetic field H in turn creates eddy currents $I_e$, which heat the ore region 4 and cause heavy hydrocarbons to flow.

The current I then flows from the conductor sleeve 20 onto the current return path 52. Since current return path 52 is a pipe, current I can flow in opposite directions on the inside surface 60 of the current return path 52 and on the outside surface 61 of the current return path 52. This is due to the RF skin effect, conductor proximity effect, and in some instances also due to the magnetic permeability of the pipe (if ferrous, for example). In other words, the conductor sleeve 20 may be electrically thick. At radio frequencies electric currents can flow independently and in opposite directions on the inside and outside of a metal tube due to the aforementioned effects. Current I thus flows on the inside surface 60 of current return path 52 in the opposite direction of the transmission line 12. This current I flowing along the inside surface 60 of the current return path is unaffected by the current choke 56. Current I flows on the outside surface 61 of current return path 52 in the same direction as the transmission line 12 and the conductive sleeve 20. This can be an advantage because the same conductor sleeve 20 can carry both a transmission line current internally and a heating antenna current externally.

Applicator 50 can include optional nonconductive couplings (not shown) between the conductive sleeves 20, such as those described above with respect to FIG. 1. Applicator 50 can also include an optional nonconductive housing (not shown), such as the one described above with respect to FIG. 1.

Figure 7:
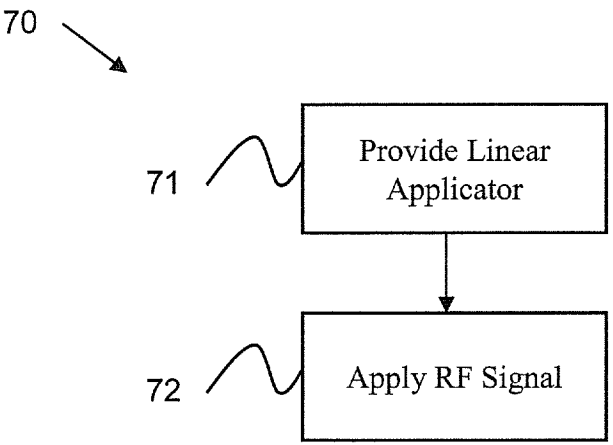
FIG. 7 is a flow diagram illustrating a method for heating a hydrocarbon formation.

FIG. 7 depicts an embodiment of a method for heating a hydrocarbon formation 70. At the step 71, a linear applicator is extended into the hydrocarbon formation. At the step 72, a radio frequency signal is applied to the linear applicator, which is sufficient to create a circular magnetic field relative to the radial axis of the linear applicator.

At the step 71, a linear applicator is extended into the hydrocarbon formation. For instance, the linear applicator can be the same or similar to the linear applicator 10 of FIG. 1. Alternatively, the linear applicator can be the same or similar to the linear applicator 50 of FIG. 5. The linear applicator is preferably placed in the ore region of the hydrocarbon formation.

At the step 72, a radio frequency signal is applied to the linear applicator sufficient to create a circular magnetic field relative to the radial axis of the linear applicator. For instance, for the linear applicators depicted in FIG. 1 and FIG. 5, a 1 to 10 kilohertz signal having about 1 Watt to 5 Megawatts power can be sufficient to create a circular magnetic field penetrating about 10 to 15 meters radially from the linear applicator into the hydrocarbon formation, however, the penetration depth and the signal applied can vary based on the composition of a particular hydrocarbon formation. The signal applied can also be adjusted over time to heat the hydrocarbon formation more effectively as susceptors within the formation are desiccated or replenished. It is contemplated that the circular magnetic field creates eddy currents in the hydrocarbon formation, which will cause heavy hydrocarbons to flow. The desiccation of the region around the antenna can be beneficial as the drying ore has increased salinity, which may increase the rate of the heating.

Figure 8:
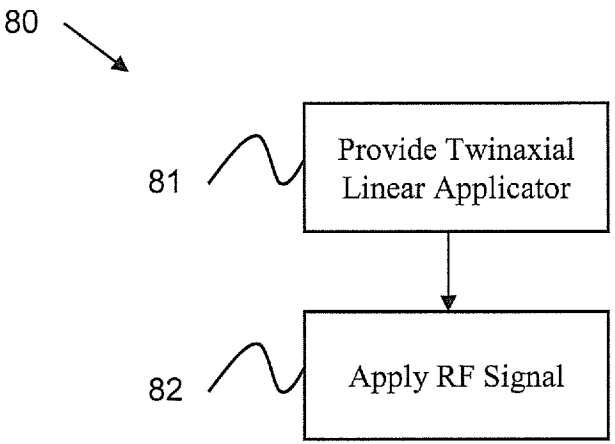
FIG. 8 is a flow diagram illustrating a method for heating a hydrocarbon formation.

FIG. 8 depicts an embodiment of a method of heating a hydrocarbon formation 80. At the step 81, a twinaxial linear applicator is provided. At the step 82, a radio frequency signal is applied to the linear applicator, which is sufficient to create a circular magnetic field relative to the radial axis of the linear applicator.

At the step 81, a twinaxial linear applicator is provided. For example, the twinaxial linear applicator can be the same or similar to the twinaxial linear applicator of FIG. 1, and can include at least, a transmission line, a current return path, one or more conductive sleeves positioned around the transmission line and the current return path where the transmission line and the current return path are connected to the conductive sleeve at opposite ends of the conductive sleeve. Each of these components and connections can be the same or similar to those described above with respect to FIGS. 1 through 4. The twinaxial linear applicator can also include any combination of the optional components described above with respect to FIG. 1.

At the step 82, a radio frequency signal is applied to the twinaxial linear applicator sufficient to create a circular magnetic field relative to the radial axis of the twinaxial linear applicator. For instance, for the twinaxial linear applicator depicted in FIG. 1, a 1 to 10 kilohertz signal having about 1 Watt to 5 Megawatts power can be sufficient to create a circular magnetic field penetrating about 10 to 15 meters radially from the twinaxial linear applicator into the hydrocarbon formation, however, the penetration depth and the signal power applied can vary based on the composition of a particular hydrocarbon formation. The prompt (or nearly so) penetration of the heating electromagnetic energies along the well is approximately the RF skin depth. A power metric can be to apply about 1 to 5 kilowatts per meter of well length. The frequency and power of the signal applied can also be adjusted over time to heat the hydrocarbon formation more effectively as susceptors within the formation are desiccated or replenished. It is contemplated that the circular magnetic field creates eddy electric currents in the hydrocarbon formation, which heat by joule effect and cause heavy hydrocarbons to flow.

Figure 9:
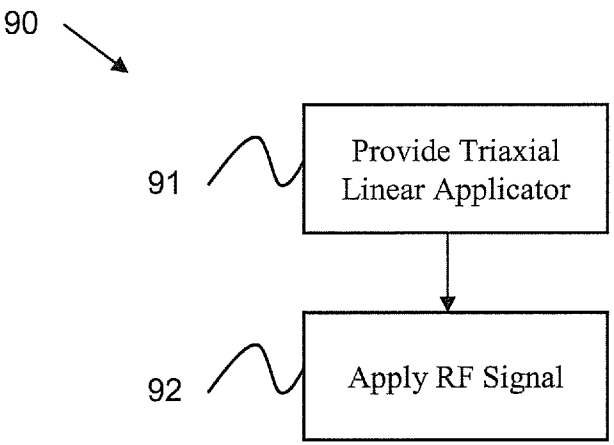
FIG. 9 is a flow diagram illustrating a method for heating a hydrocarbon formation.

FIG. 9 depicts an embodiment of a method of heating a hydrocarbon formation 90. At the step 91, a triaxial linear applicator is provided. At the step 92, a radio frequency signal is applied to the linear applicator, which is sufficient to create a circular magnetic field relative to the radial axis of the linear applicator.

At the step 91, a triaxial linear applicator is provided. For example, the triaxial linear applicator can be the same or similar to the triaxial linear applicator of FIG. 5, and can include at least, a transmission line, a current return path, one or more conductive sleeves positioned around the current return path where the transmission line and the current return path are connected to the conductive sleeve at opposite ends of the conductive sleeve. Each of these components and connections can be the same or similar to those described above with respect to FIGS. 5 and 6. The triaxial linear applicator can also include any combination of the optional components described above with respect to FIGS. 5 and 6.

At the step 92, a radio frequency signal is applied to the triaxial linear applicator sufficient to create a circular magnetic field relative to the radial axis of the triaxial linear applicator. For instance, for the triaxial linear applicator depicted in FIG. 5, a 1 to 10 kilohertz signal having about 1 Watt to 5 Megawatts power can be sufficient to create a circular magnetic field penetrating about 10 to 15 meters radially from the linear applicator into the hydrocarbon formation, however, the penetration depth and the signal applied can vary based on the composition of a particular hydrocarbon formation. The signal applied can also be adjusted over time to heat the hydrocarbon formation more effectively as susceptors within the formation are desiccated or replenished. It is contemplated that the circular magnetic field creates eddy currents in the hydrocarbon formation, which will cause heavy hydrocarbons to flow.

Figure 10:
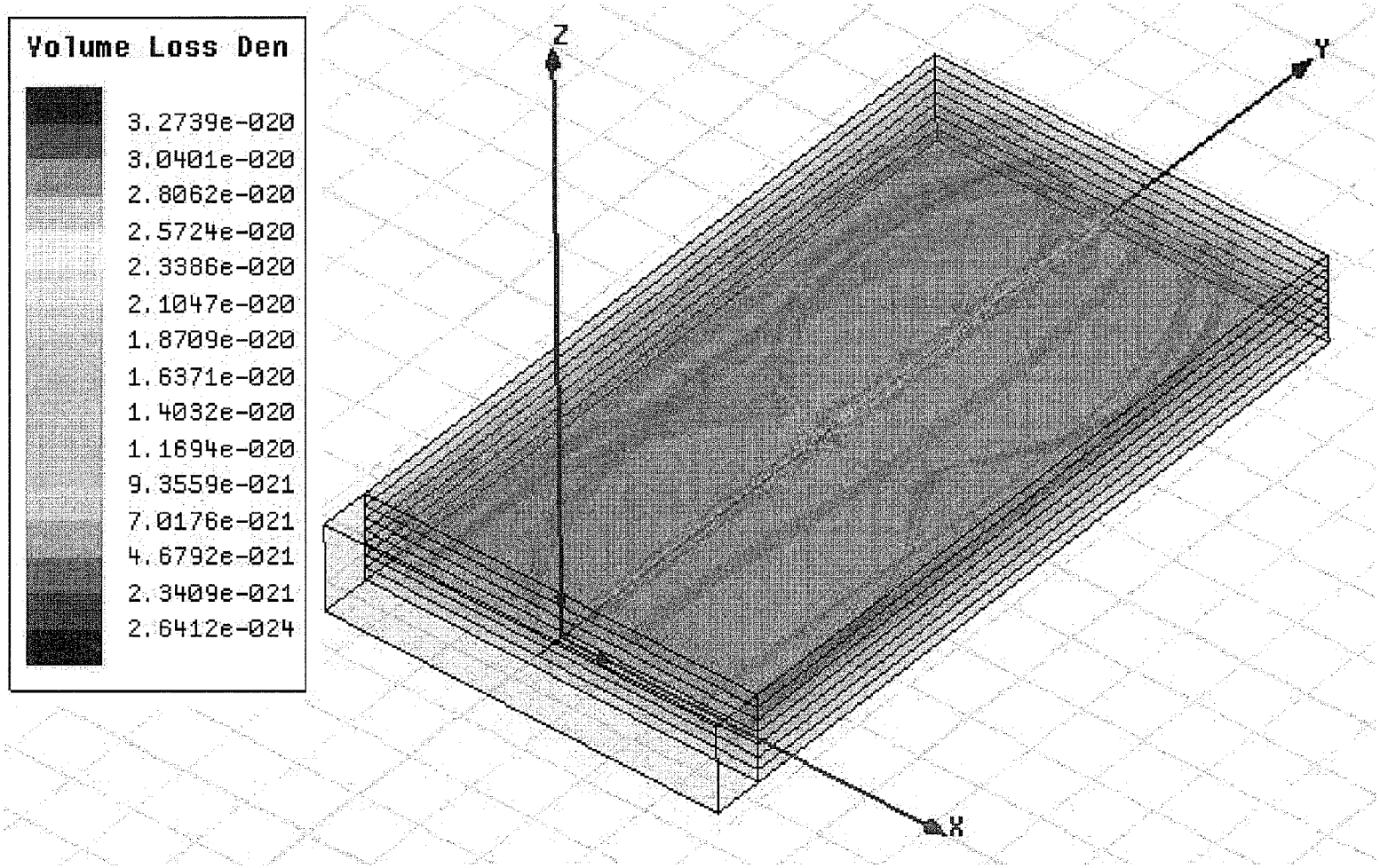
FIG. 10 is an overhead view on a representative RF heating pattern for a twinaxial linear applicator according an embodiment.

A representative RF heating pattern will now be described. FIG. 10 depicts an isometric or overhead view of an RF heating pattern for a heating portion of two element array twinaxial linear applicator, which may be the same or similar to that described above with respect to FIG. 1. The heating pattern depicted shows RF heating rate of a representative hydrocarbon formation for the parameters described below at time t=0 or just when the power is turned on. 1 watt of power was applied to the antenna applicator to normalize the data. As can be seen, the heating rate is smooth and linear along the conductive sleeves 20 and this is due to arraying of many sleeves 20 to smooth the current flow along the antenna. There is a hotspot at the conductive jumpers 22, 24 but this will not rise above the boiling temperature of water in the formation so coking will not occur there in the ore. The realized temperatures (not shown) are a function of the duration of the heating and the applied power, as well as the specific heat of the ore.

The FIG. 10 well dimensions are as follows: the horizontal well section is 1 kilometers long and at a depth of 30 meters, applied power is 1 Watt and the heat scale is the specific absorption rate in watts/kilogram. The heating pattern shown is for time t=0, for example, when the RF power is first applied. The frequency is 1 kilohertz (which is sufficient for penetrating many hydrocarbon formations). Formation electrical parameters were permittivity=500 farads/meter and conductivity=0.0055 mhos/meter, which can be typical of rich Canadian oil sands at 1 kilohertz.

Rich Athabasca oil sand ore was used in the model at a frequency of 1 KHz and the ore conductivities used were from an induction resistivity log. Raising the frequency increases the ore load electrical resistance reducing wiring gauge requirements, decreasing the frequency reduces the number of conductive sleeves 20 required. The heating is reliable as liquid water contact to the antenna applicator is not required. Radiation of waves was not occurring in the FIG. 10 example and the heating was by magnetic induction. The instantaneous half power radial penetration depth from the antenna applicator 10 can be 5 meters for lean Athabasca ores and 9 meters for rich Athabasca ores as the dissipation rate that provides the heating is increased with increased conductivity. Of course any heating radius can be accomplished over time by growing a steam bubble/steam saturation zone or allowing for conduction and/or convection to occur. As the thermal conductivity of bitumen is low the speed of heating can be much faster than steam at start up. The electromagnetic fields readily penetrate rock strata to heat beyond, whereas steam will not.

Figure 11:
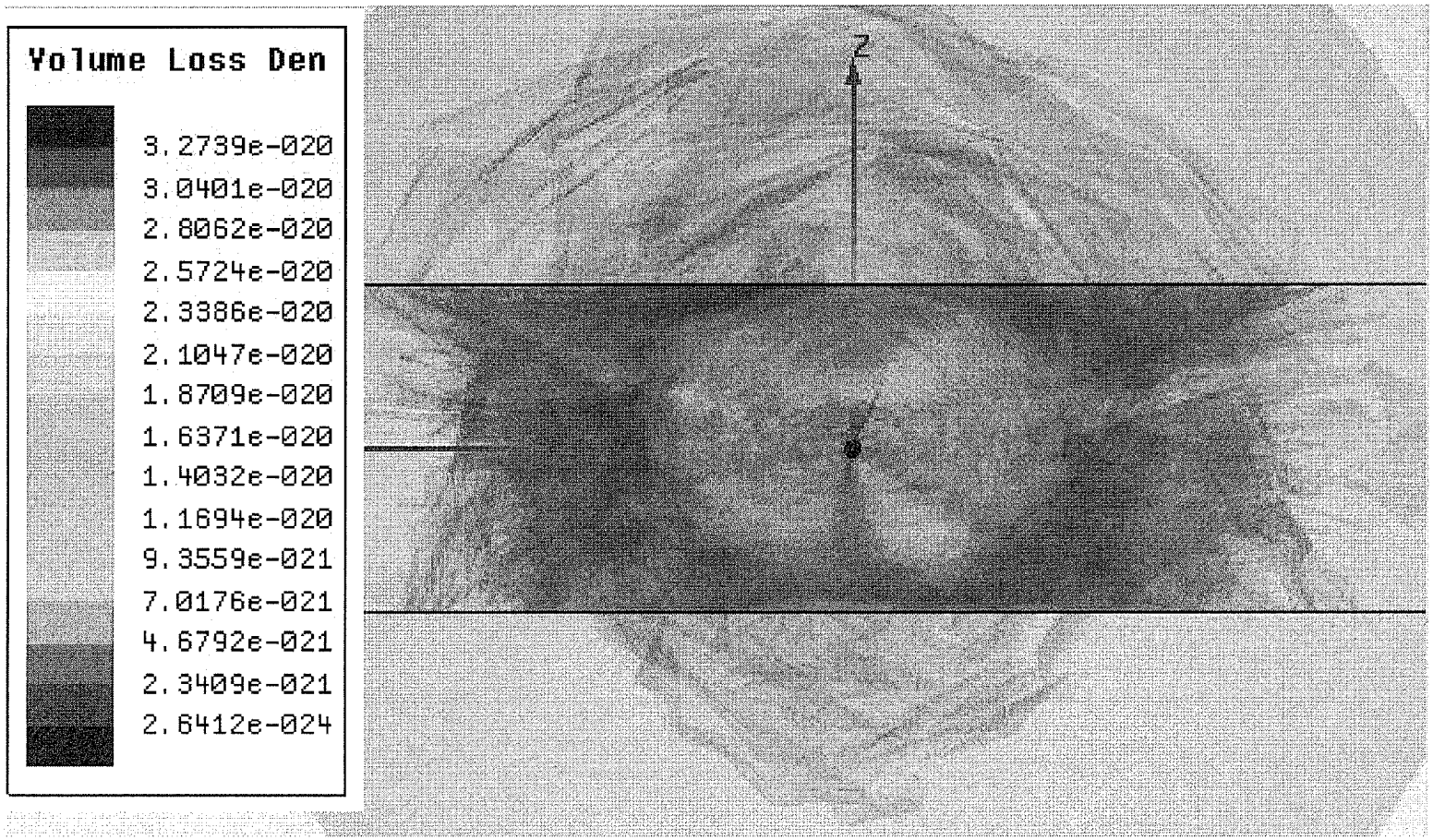
FIG. 11 is a cross sectional view on a representative RF heating pattern for a twinaxial linear applicator according an embodiment.

FIG. 11 depicts a cross sectional view of an RF heating pattern for a twinaxial linear applicator according to the same parameters. The applicator 10 includes the conductive sleeve 20 which is shown in cross section. FIG. 11 maps the contours of the rate of heat application in watts per meter cubed at time t=0, for example, just as the electric power has just been turned on. The antenna is being supplied 1 watt of power to normalize the data. The ore is rich Athabasca oil sand 20 meters thick. Both induction heating by circular magnetic near field and displacement current heating by near electric field are evident. The capacitive or electric field or displacement current portion of the heating causes vertical heat spreading 92. There is also boundary condition heating 94 between the ore and underburden and this acts to increase the heat spread horizontally, which can be beneficial. The overburden 4 and underburden 96 are partially akin to conductive plates so a parallel plate capacitor is effectively formed underground with the ore becoming the capacitor dielectric. Aspects of parallel transmission lines such as radial waveguide or balanced microstrip may also be analogous. The realized temperatures will be a function of the applied power and the duration of the heating limited at the boiling temperature at the reservoir conditions, which may be 200 C to 260 C depending on depth. A contemplated method is to grow a steam saturation zone or "steam bubble" in the ore around the antenna and for the antenna electromagnetic fields to heat on the wall of this bubble. Thus, one can provide gradual heating to any desired penetration radius from the antenna. Water in the steam state is not a RF heating susceptor so a steam saturation zone allows expansion of the antenna fields therein without dissipation. The field may grow to reach the extraction cavity bitumen melt wall as needed.

Numerical electromagnetic methods were used to perform the analysis which physical scale model test validated. Underground propagation constants for electromagnetic fields include the combination of a dissipation rate and a field expansion rate, as the fields are both turning to heat and the flux lines are being stretched with increasing radial distance and circumference. The radial field expansion or spreading rate is $1/r^2$. The radial dissipation rate is a function of the ore conductivity and it can be $1/r^3$ to $1/r^5$ in some formations. The higher electrical conductivity formations may have a higher radial dissipation rate.

Figure 12:
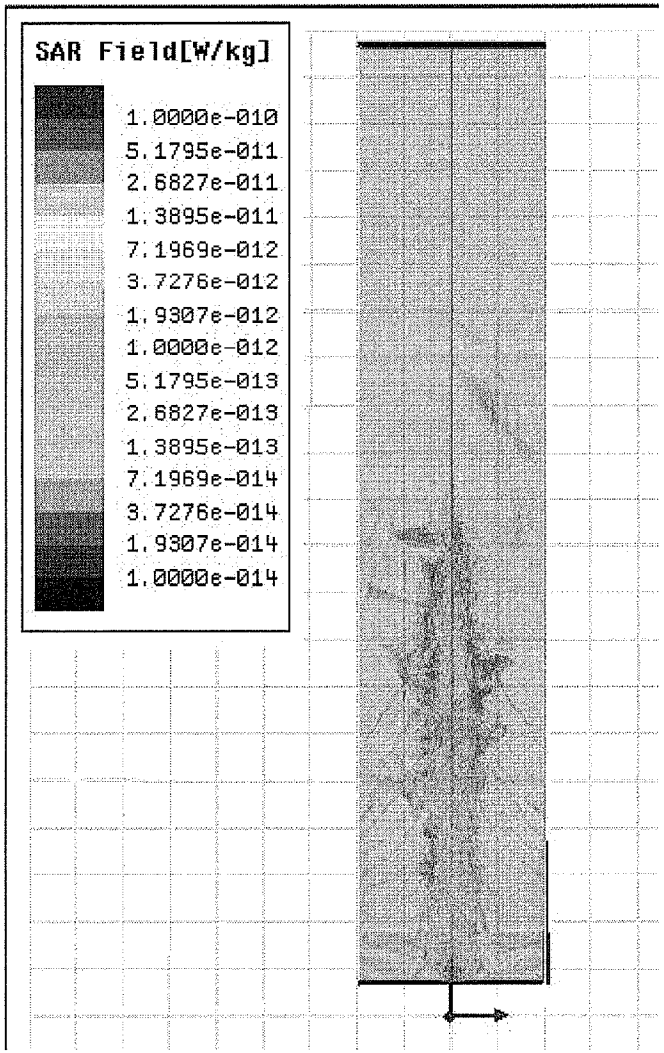
FIG. 12 is an overhead view on a representative RF heating pattern for a triaxial linear applicator according to an embodiment.
Figure 13:
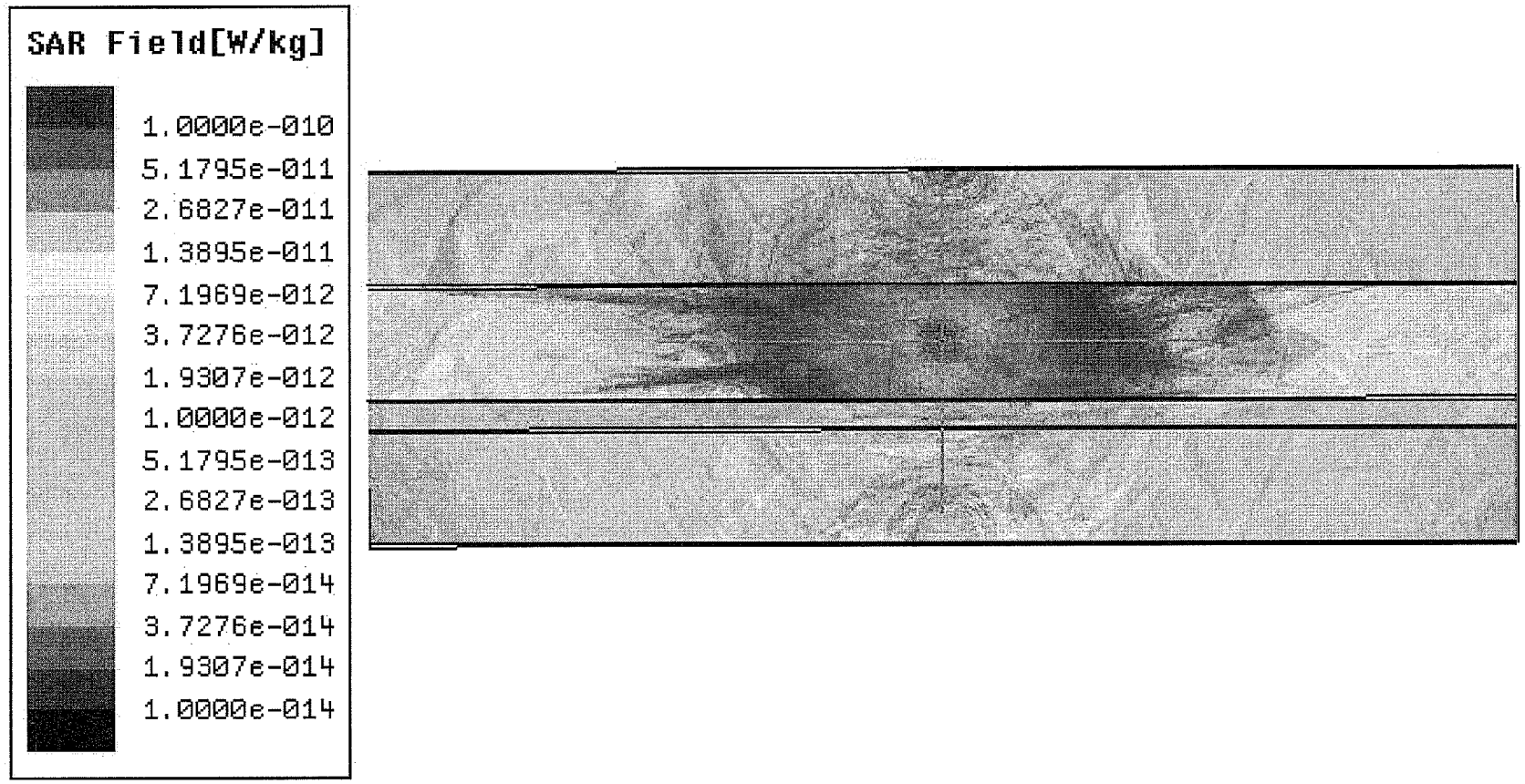
FIG. 13 is a cross sectional view on a representative RF heating pattern for a triaxial linear applicator according to an embodiment.

A representative RF heating pattern will now be described. FIG. 12 depicts an overhead view of an RF heating pattern for a triaxial linear applicator, which may be the same or similar to that described above with respect to FIG. 5. The heating pattern depicted shows RF heating of a representative hydrocarbon formation for the parameters described below. FIG. 13 depicts a cross sectional view of an RF heating pattern for a triaxial linear applicator according to the same parameters. Numerical electromagnetic methods were used to perform the analysis.

The FIG. 12 well dimensions are as follows: the horizontal well section is 0.4 kilometer long and at a depth of 800 meters, applied power is 1 watt, and the heat scale is the specific absorption rate in watts/kilogram. The heating pattern shown is for time t=0, for example, when the RF power is first applied. The frequency is 1 kilohertz (which is sufficient for penetrating many hydrocarbon formations). Formation electrical parameters were permittivity=500 farads/meter and conductivity=0.0055 mhos/meter, which can be typical of rich Canadian oil sands at 1 kilohertz. The unnormalized load resistance at the terminals of the antenna was Z=r+jX=411+0.4j ohms.

Although the technology is not so limited, heating may primarily occur from reactive near fields rather than from radiated far fields. The heating patterns of electrically small antennas in uniform media may be simple trigonometric functions associated with canonical near field distributions. For instance, a single line shaped antenna, for example, a dipole, may produce a two petal shaped heating pattern due the cosine distribution of radial electric fields as displacement currents (see, for example, *Antenna Theory Analysis and Design*, Constantine Balanis, Harper and Roe, 1982, equation 4-20a, pp 106). In practice, however, hydrocarbon formations are generally inhomogeneous and anisotropic such that realized heating patterns are substantially modified by formation geometry. Multiple RF energy forms including electric current, electric fields, and magnetic fields interact as well, such that canonical solutions or hand calculation of heating patterns may not be practical or desirable.

Far field radiation of radio waves (as is typical in wireless communications involving antennas) does not significantly occur in applicators immersed in hydrocarbon formations 4. Rather the antenna fields are generally of the near field type so the flux lines begin and terminate on the antenna structure. In free space, near field energy rolls off at a $1/r^3$ rate (where r is the range from the antenna conductor) and for small wavelengths relative to the length of the antenna it extends from there to $\lambda/2\pi$ (lambda/2 pi) distance, where the radiated field may then predominate. In the hydrocarbon formation 4, however, the antenna near field behaves much differently from free space. Analysis and testing has shown that dissipation causes the rolloff to be much higher, about $1/r^5$ to $1/r^8$. This advantageously limits the depth of heating penetration to substantially that of the hydrocarbon formation 4.

Several methods of heating are possible with the various embodiments. Conductive, contact electrode type resistive heating in the strata may be accomplished at frequencies below about 100 Hertz initially. In this method, the applicator's conductors comprise electrodes to directly supply electric current. Later, the frequency of the radio frequency source 16 can be raised as the in situ liquid water boils off the conductive sleeves 20 surfaces, which continues the heating that could otherwise stop as electrical contact with the water in the formation is lost cause the electrical circuit with the formation to open. A method contemplated is therefore to inject electric currents initially, and then to elevate the radio frequency to maintain energy transfer into the formation by using electric fields and magnetic fields, both of which do not require conductive contact with in situ water in the formation.

Another method of heating is by displacement current by the application of electric near fields into the underground formation, for example, through capacitive coupling. In this method, the capacitance reactance between the applicator and the formation couples the electric currents without conductive electrode-like contact. The coupled electric currents then heat by joule effect.

Another method of heating with the various embodiments is the application of magnetic near fields (H) into the underground strata by the applicator to accomplish the flow of eddy electric currents in the ore by inductive coupling. The eddy electric currents then heat the ore strata by resistance heating or joule effect, such that the heating is a compound process. The applicator is akin to a transformer primary winding and the ore the secondary winding, although windings do not exist in the conventional sense. The magnetic near field mode of heating is reliable as it does not require liquid water contact with the applicator. The electric currents flowing along the applicator surfaces create the magnetic fields, and the magnetic fields curl in circles around the antenna axis. For certain embodiments and formations, the strength of the heating in the ore due to the magnetic fields and eddy currents is proportional to:

$$P=\pi^2B^2d^2f^2/12\rho D$$

Where:

P=power delivered to the ore in watts

B=magnetic flux density generated by the well antenna in Teslas

D=the diameter of the well pipe antenna in meters

P=the resistivity of the hydrocarbon ore in ohmmeters=$1/\sigma$ f=the frequency in Hertz D=the magnetic permeability of the hydrocarbon ore The strength of the magnetic flux density B generated by the applicator derives from amperes law and is given by:

$$B_\Phi=\mu ILe^{-jkr}\sin\theta/4\pi r^2$$

Where:

$B_\varphi$=magnetic flux density generated by the well antenna in Teslas

μ=magnetic permeability of the ore

I=the current along the well antenna in amperes

L=length of antenna in meters $e^{-jkr}$=Euler's formula for complex analysis=cos(kr)+j sin (kr)

θ=the angle measured from the well antenna axis (normal to well is 90 degrees)

r=the radial distance outwards from the well antenna in meters

Any partially electrically conductive ore can be heated by application of magnetic fields from the embodiment as long as the resistance of the applicator's electrical conductors (metal pipe, wires) is much less than the ore resistance. The Athabasca oil sands are ores of sufficient electrical conductivity for practical magnetic field and eddy current heating and the electrical parameters may include currents of 100 to 800 amperes at frequencies of 1 to 20 KHz to deliver power at rates of 1 to 5 kilowatts per meter of well length. The intensity of the heating rises with the square of frequency so ores of widely varying conductivity can be heated by raising or lowering the frequency of the transmitter. For example, raising the frequency increases the load resistance the ore provides. In addition to the closed form equations, modern numerical electromagnetic methods can be used to map the underground heating using moment methods and finite element models. The formation induction resistivity logs are used as the input in the analysis map. The more conductive areas heat faster than the less conductive ones. The heating rate of a given strata is linearly proportional to conductivity. The prompt (nearly speed of light) distribution of the electromagnetic heating energy axially along the antenna is approximately related to the RF skin effect which is:

$$\delta=\sqrt{(1/\pi f\mu\sigma)}$$

Where:

δ=the RF skin depth=1/e f=the frequency in Hertz

μ=the magnetic permeability of the ore (generally unity for hydrocarbon ores)

σ=the ore conductivity in mhos/meter

Thus, various embodiment may advantageously allow for heating of ores of varying conductivity. The length of the conductive sleeves 20 ($I_{sleeve}$) may in general be about one (1) skin depth long $I_{sleeve}\approx\delta$. The more conductive underground ores may generally use shorter conductive sleeves 20 and the less conductive ores longer conductive sleeves 20.

The radial gradient of the prompt spread electromagnetic heating energy is about $1/r^5$ to $1/r^7$ in Athabasca oil sand ores. This is due to the combination of two things: 1) the geometric spreading of the magnetic flux and 2) the dissipation of the magnetic field to produce the heat. The magnetic field radial spreading term is independent of ore conductivity, is $1/r^2$, and is due to the magnetic flux lines stretching to larger circumferences as the radius away from the applicator is increased. The prompt magnetic field radial dissipation term varies with the ore conductivity, and it may be $1/r^3$ to $1/r^5$ in practice.

There are both prompt and gradual heating effects with certain embodiments. A gradual heating mechanism providing heating to almost any radial depth of heat penetration may be accomplished by growth of a steam saturation zone or steam bubble around the underground applicator, which allows magnetic field expansion in the steam saturation zone without dissipation. The magnetic fields then dissipate rapidly at the wall of the steam saturation zone. The gradual heating can be to any depth as the magnetic fields will heat on the steam front wall in the ore. Thus, a wave like advancing steam front may be created by the embodiments. Other gradual heat propagation modes may also be included, such as conduction and convection, in addition to the prompt propagation of the electromagnetic heating energy.

Another method of heating contemplated is to heat by radiation of electromagnetic waves from the applicator after the underground formation has warmed and a steam saturation zone has formed around the applicator. Initially, rapid dissipated of applicator reactive near fields, both electric and magnetic may generally preclude the formation of far field electromagnetic waves in the ore. However, after liquid water adjacent to the applicator has turned to steam the steam saturation zone comprises a nonconductive dielectric cavity that permits the near fields to expand into waves. The lower cutoff frequency of the steam cavity can correspond to a radius of about $0.6\lambda_m$ depending on the waveguide mode, where $\lambda_m$ is the wavelength in the steam saturation zone media. The wave mode of heating provides a rapid thermal gradient at the steam front wall in the underground ore. Electromagnetic waves therefore melt the ore at the production front.

Water may also be produced with the oil, thereby, maximizing the hydrocarbon mobility. Athabasca oil sands generally consist of sand grains coated with water then coated with a bitumen film. So, water and bitumen are distributed intimately with each other in the formation as a porous microstructure. Moreover, water can heat by several electromagnetic mechanisms including induction and joule effect, and dielectric heating. It is also possible to heat bitumen molecules directly with electric fields by molecular dipole moment. The preferred frequency for the dipole moment heating of hydrocarbons varies with the molecular weight of the hydrocarbon molecule.

Thus, certain embodiment of the disclosed technology can accomplish stimulated or alternative well production by application of RF electromagnetic energy in one or all of three forms: electric fields, magnetic fields and electric current for increased heat penetration and heating speed. The antenna is practical for installation in conventional well holes and useful for where steam may not be used or to start steam enhanced wells. The RF heating may be used alone or in conjunction with other methods and the applicator antenna is provided in situ by the well tubes through devices and methods described.

Although preferred embodiments have been described using specific terms, devices, and methods, such description is for illustrative purposes only. The words used are words of description rather than of limitation. It is to be understood that changes and variations can be made by those of ordinary skill in the art without departing from the spirit or the scope of the present invention, which is set forth in the following claims. In addition, it should be understood that aspects of the various embodiments can be interchanged either in whole or in part. Therefore, the spirit and scope of the appended claims should not be limited to the description of the preferred versions contained herein.

The invention claimed is:

1. An applicator for heating a hydrocarbon formation comprising:

a transmission line;

a current return path spaced apart and electrically insulated from the transmission line, the current return path surrounding the transmission line to create a coaxial conductor;

a radio frequency (RF) source connected to the transmission line and the current return path, the RF source being configured to supply RF power to the transmission line; and at least one conductive sleeve having first and second ends around the transmission line and the current return path, the transmission line being electrically connected to the first end of the at least one conductive sleeve and the current return path being electrically connected to the second end of the at least one conductive sleeve.

2. The applicator of claim 1, wherein the current return path comprises a pipe.

3. The applicator of claim 1, further comprising a current choke positioned around the current return path.

4. The applicator of claim 1, further comprising a nonconductive housing positioned around the transmission line, the current return path, and the at least one conductive sleeve.

5. The applicator of claim 1, wherein the at least one conductive sleeve comprises at least one litz bundle.

6. The applicator of claim 5, further comprising:

at least one first header flange connected to the first end of the at least one litz bundle and connected to the transmission line; and at least one second header flange connected to the second end of the at least one litz bundle and connected to the current return path.

7. The applicator of claim 1, wherein the at least one conductive sleeve comprises metal.

8. The applicator of claim 1, wherein the at least one conductive sleeve is about 40 meters long.

9. The applicator of claim 1, wherein the RF source is configured to supply the RF power at a frequency in a range of 1 kilohertz to 10 kilohertz.

10. The applicator of claim 1, wherein the at least one conductive sleeve comprises a plurality of spaced apart conductive sleeves.

11. The applicator of claim 10, further comprising at least one nonconductive coupling between adjacent ones of said plurality of spaced apart conductive sleeves.

12. A method for applying heat to a hydrocarbon formation comprising:

extending a triaxial linear applicator into the hydrocarbon formation; and applying radio frequency (RF) power to the triaxial linear applicator sufficient to create a circular magnetic field relative to a radial axis of the triaxial linear applicator.

13. The method of claim 12, wherein RF power is applied so that:

a steam saturation zone is grown in the hydrocarbon formation around the triaxial linear applicator;

electromagnetic energy propagates through the steam saturation zone; and heating occurs at a wall of the steam saturation zone.

* * * * *